United States Patent [19]

Horgan, Jr.

[11] Patent Number: 4,523,414

[45] Date of Patent: Jun. 18, 1985

[54] GLASS DOOR ASSEMBLY WITH TRANSOM BAR

[75] Inventor: William J. Horgan, Jr., Pittsburgh, Pa.

[73] Assignee: Blumcraft of Pittsburgh, Pittsburgh, Pa.

[21] Appl. No.: 496,135

[22] Filed: May 19, 1983

[51] Int. Cl.[3] ..... E06B 1/04

[52] U.S. Cl. ..... 52/204; 52/213; 52/235; 49/388

[58] Field of Search ..... 52/204, 235, 39, 207, 52/213; 49/388

[56] References Cited

U.S. PATENT DOCUMENTS

| | | | |
|---|---|---|---|
| 3,114,942 | 12/1963 | Abedon | 49/388 |
| 3,685,240 | 8/1972 | Oscari | 52/235 |
| 3,895,412 | 7/1975 | Johnson | 49/388 |
| 4,307,547 | 12/1981 | Kern | 52/39 |

*Primary Examiner*—Henry E. Raduazo
*Assistant Examiner*—Caroline Dennison
*Attorney, Agent, or Firm*—Paul & Paul

[57] ABSTRACT

A glass door assembly is provided with at least one door, at least one sidelight, and a transom above the door, with a transom bar disposed beneath the glass transom, with the transom bar being supported from above the transom, such as from a ceiling, and preferably in such a way as to present an unsupported, floating appearance for the bar. The bar is carried by rods at ends of the transom, with the weight of the transom being supported by the transom bar, and with the rods preferably being unobtrusive and hidden from view. The transom bar is provided with a bearing arrangement for facilitating the pivoting of a door pivot therein. A number of adjustment features are provided, for the bearing of the door pivot, and for the transom support rod, both vertically and laterally. The transom bar also ties in with sidelights at its ends, for mutual support between the sidelight, the transom bar and the transom, all of which cooperate to provide rigidifying support for the door.

17 Claims, 5 Drawing Figures

GLASS DOOR ASSEMBLY WITH TRANSOM BAR

BACKGROUND OF THE INVENTION

In the art of door design, it has become architecturally fashionable to use large expanses of glass, for aesthetic reasons. In doing so, the tendency has been to minimize the use of obtrusive supporting structures, to permit maximum aesthetic presentation of the glass.

Where doors are being utilized across an opening, it has also become desirable to enhance the presentation of the doors by using glass sidelights on the sides of the doors, and, where possible, to use a pair of openable doors. Where ceiling height permits, it has also become fashionable to utilize a glass transom above the doors.

In such constructions, particularly where two sidelights are utilized along with a transom, and with a double door arrangement, each sidelight is secured to the building structure at the ceiling, floor, and along one wall. Such can be done by embedding the sidelight into the building structure at those locations, so as to minimize the presentation of glass fixtures. When the glass is embedded in the building structure, generally fixtures will be utilized, but they will preferably be embedded to as to give a clear, unbroken presentation of the glass.

Similarly, in the past, the glass transom has been embedded into the building structure at its upper end, along with a suitable fixture for carrying the same, and the glass hangs downwardly to a position just above the upper ends of the door or doors. Generally, also, the transom will be notched out at its lower end, at those locations at which it is necessary to accommodate one or more bearings for door pivot pins, in order to permit the doors to move between open and closed positions. Usually, also, the transom and sidelights are provided with fixtures in the notched-out portions of the transom, for tying the side light to the transom at each end of the transom, for facilitating mutual support between the transom and sidelight at each such location, in directions at right angles to the planes of the glass, and also to provide support for the upper pivot bearing for an associated door, likewise in directions at right angles to the glass. Also, bearings for doors are mounted in the notched-out portions of the transom.

In such constructions heretofore employed, the transom is essentially hanging from the ceiling, and after the passage of time, with or without minor building movement as for example due to settlement, stresses can become induced in the glass that may render the glass prone to breakage, if, as for example, the door is violently slammed, or if a door or side light is accidentally struck. In such a case, the transom may shatter and fall, causing damage to persons or property.

THE PRESENT INVENTION

The present invention is addressed to providing an unobtrusive support for the transom, in the form of a slim bar extending beneath the transom, and for providing a facility for accommodating the bearing for an upper pivot for the door, without requiring notching of the transom or sidelight glass, and accomplishes the same by hanging a transom support bar from support rods that, in turn, are carried by the building structure above the ceiling level. The rods may be slim and substantially concealed between mating edges of the transom and sidelight, thereby presenting the transom bar as though unsupported, or floating in appearance. A number of adjustment features are also provided for the rods, the bar, and the pivot bearing carried thereby.

Accordingly, it is an object of this invention to provide a novel glass door assembly having a simple, uncluttered appearance.

It is another object of this invention to provide a support for a glass transom, that is unobtrusive, but which substantially or completely carries the weight of the transom.

It is another object of this invention to provide a glass door assembly that accommodates a tie-in between the transom and one or more sidelights, without requiring notching of either.

It is a further object of this invention to provide a support for an upper pivot bearing or other hinge-like structure for the upper end of a door, without requiring a cutout of an adjacent transom or sidelight, but in drawing support from the building structure itself.

It is another object of this invention to draw support for either or both of a door pivot bearing and/or transom support bar, by means of hanging rods that extend between a transom edge and the edge of an adjacent sidelight, which rods are unobtrusively hidden in a joint formed therebetween.

Other objects and advantages of the present invention will be readily apparent from a reading of the following brief descriptions of the drawing figures, detailed descriptions of the preferred embodiments and the appended claims. It will be understood that, while a preferred embodiment of this invention presents it in the form of a pair of doors, hinged or pivoted at their outer ends, with a transom thereabove and sidelights on each side, it will also be apparent that, depending upon the particular architectural needs of a given situation, a single door only may be used, with one or more sidelights, as the situation permits. In some cases, where only one sidelight may be used, it may be desirable to mount the transom support bar directly to the wall of a building structure at one end, and to have the other end of the transom support bar only, hanging from the ceiling. Thus it will be apparent that designers may use many combinations of the features presented herein, with many variations.

BRIEF DESCRIPTIONS OF THE DRAWING FIGURES

In the drawings:

FIG. 1 is a front elevational view of a typical glass door assembly in accordance with this invention.

FIG. 2 is an enlarged detail view of that portion II of the assembly of FIG. 1, illustrating a portion of the transom bar and upper building support in section, but wherein the disposition of a support rod between edges of transom and side light glass is most clearly illustrated, together with the upper and lower adjustments therefor, and an adjustment feature for a door pivot bearing carried by the transom bar.

Figure 5:
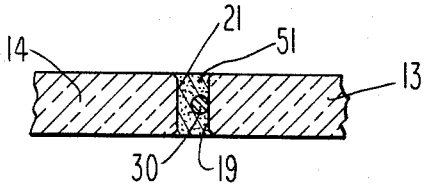
Figure 2:
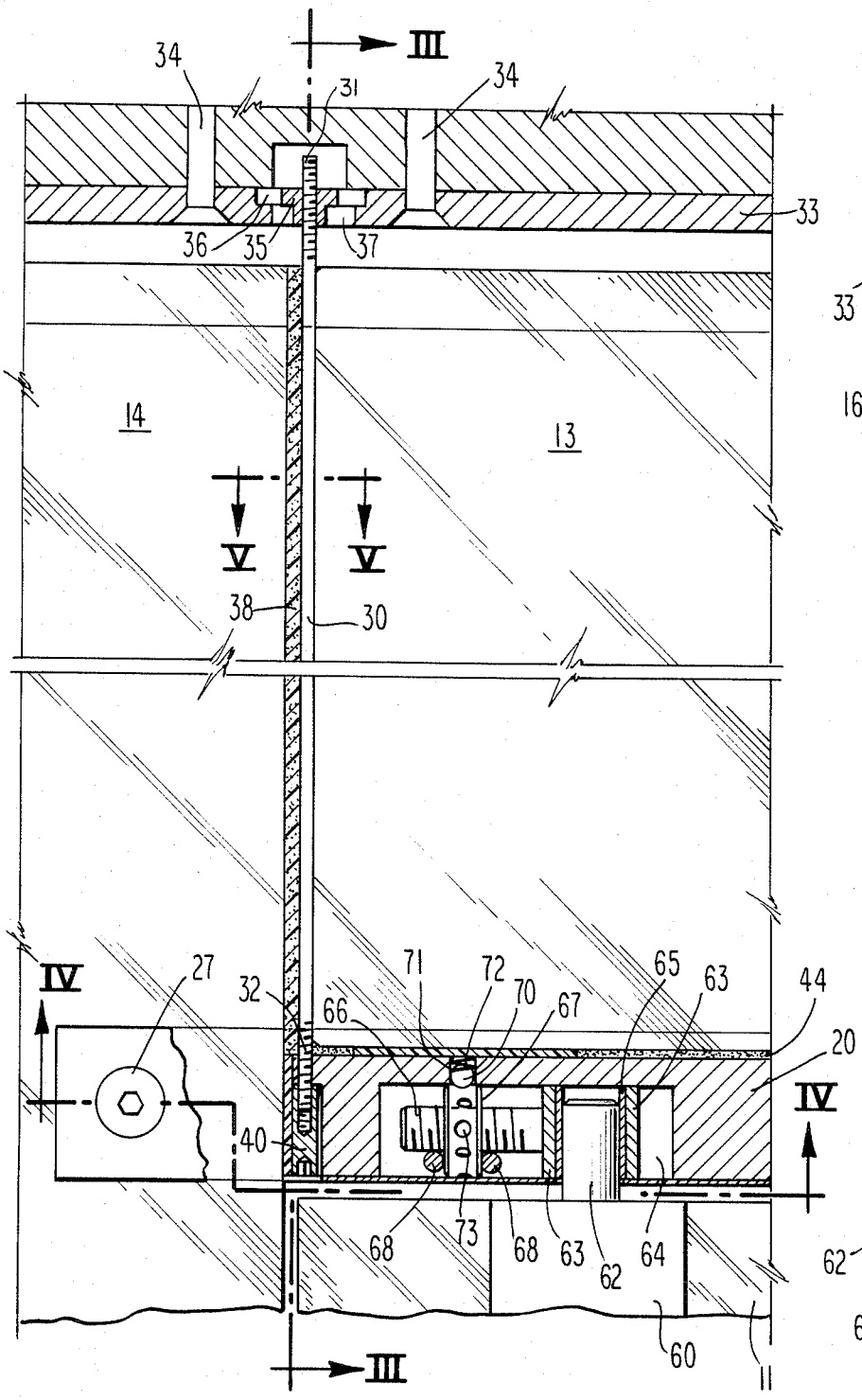

FIG. 5 an enlarged sectional view, taken through a joint formed between the transom and adjacent side light, along the Line V—V of FIG. 2.

DETAILED DESCRIPTION OF THE PREFERRED EMBODIMENTS

Figure 1:
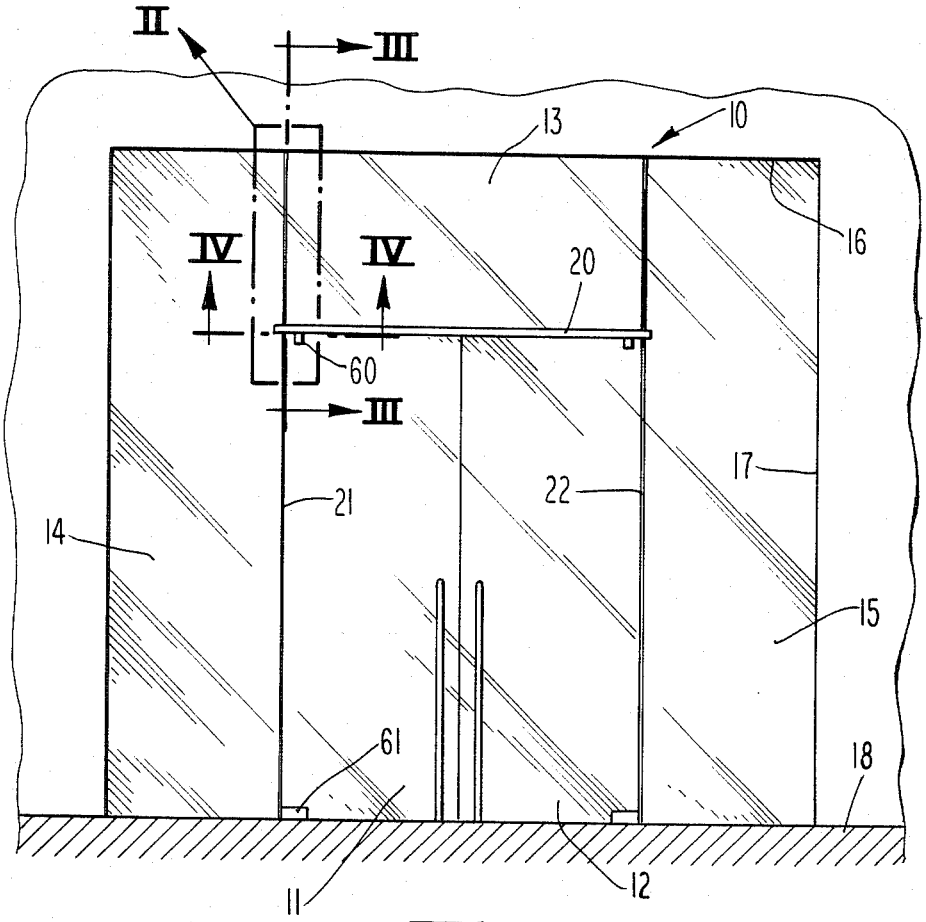

Referring now to the drawings in detail, reference is first made to FIG. 1, wherein the assembly generally designated by the numeral 10 is illustrated, as comprising doors 11 and 12, with a transom 13 disposed thereabove, and sidelights 14 and 15.

The sidelights 14 and 15 will generally be embedded in ceiling, side wall and floor portions of a building structure, either directly, or preferably in a suitable channel therein carrying the same, or in any other manner known in the art, and such mounting constructions are not specifically addressed herein.

A transom bar 20 is provided above the doors 11 and 12. The transom bar 20 is of a length that is wider than the space between sidelight edges 21 and 22, with each end of the bar being provided with a channel 23 therein for receiving an adjacent edge 21 of side lightglass therein.

Figure 4:
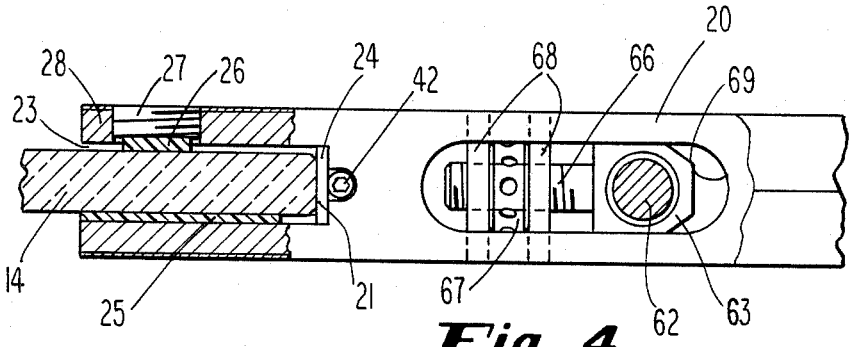
FIG. 4 is a view looking upwardly from beneath the transom bar, and partially in section through the leftmost end of the transom bar and associated side light glass, along the Line IV—IV of FIG. 2

Glass setting pads 24 and 25 may be provided, lining the channel 23 on two sides, but a pressure pad 26 would generally be provided carried by a tightenable threaded member 27 in leg 28 of the bar, as is indicated in FIG. 4, for securely tying-in the bar 20 to the side light glass as shown.

Figure 3:
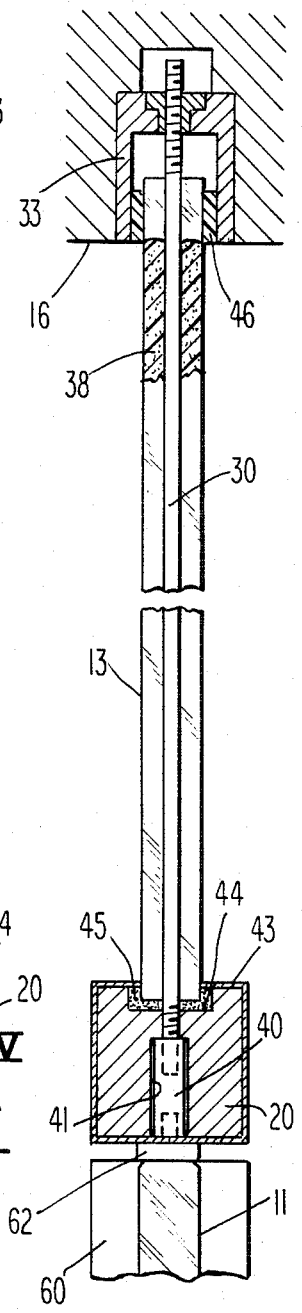
FIG. 3 is a vertical sectional view through the transom bar and ceiling level building support structure taken generally along the Line III—III of FIG. 2.

At each end of the bar 20, a support rod 30 is provided, threaded at upper and lower ends at 31 and 32 as shown. At its upper end, the threaded member 31 is carried in a header 33 mounted above the level of ceiling 16. The header 33 is preferably in the form of an inverted U-shaped channel structure, as illustrated in FIG. 3 in cross-section, embedded within the ceiling 16. The channel 33 may be bolted into a ceiling beam (not shown) or the like by means of fasteners 34. The channel 33 accommodates an adjustable rod nut 35 for each rod 30 at the upper end of the rod 30, threadingly receiving the upper end of the rod 30. The nut 35 is slideably moveable leftward or rightward, as viewed in FIG. 2, in guideways 36, 37, to provide a means of adjustment of position of the rod 30 in the space 38 between the transom and adjacent sidelight. The rod 30 is also vertically positionable by threading its upper end 31 into the nut 35. At the lower end of the rod 30, it is likewise in threaded engagement with an adjustment nut 40 that in turn, is carried in a shoulder bore 41 in the lower end of bar 20, with the nut 40 being adjustable by means of an allen screw opening 42 or the like, for facilitating turning of the same and thereby positioning the bar 20 upward or downward somewhat along the rod 30.

The bar 20 will preferably be provided with aesthetic covers 43, as shown. At the upper end of the bar 20, there is provided a channel 44, having glass setting blocks or pads 45 therein, for receiving the transom glass 13 therein, for seating the same. At the upper end of the transom 13, the glass is likewise received in channel 33 between appropriate pads 46. It will thus be seen that the transom 13 is carried by the transom bar 20 which in turn is carried by a pair of transom support rods 30 hanging from the ceiling 16.

It will be noted that a joint 50 is provided between glass sidelight edge 21 and adjacent transom edge 19, and that rod 30 is preferably mounted immediately adjacent the transom glass edge 19. A sealant, such as silicone 51 covers the rod 30 and forms a joint 50 between edges 19 and 21, substantially burying the rod 30 so that, given the preferred small cross-sectional size of the rod 30 relative to the thickness of the glass as shown in FIG. 5, the support rods 30 appeared nonexistent leaving the transom bar 20 having an unsupported, or floating appearance.

It will be seen that the door 11 is provided with a pivot 60 at its upper end, and a lower pivot 61. The present invention addresses the upper pivot 60, which is provided with an upstanding pivot pin 62. The pivot pin 62 is rotationally accommodated by a pivot pin bearing 63 carried in a recess 64 in transom bar 20, as is best shown in FIGS. 2 and 4. The bearing 63 is provided with an internal bearing sleeve 65 of suitable high-slip characteristics, accommodating the pivoting action of the door 11. The bearing 63 is moveable leftward or rightward as viewed in FIG. 4, in the slotted opening shown for the recess 64, an amount permitted by the adjustment feature at the left end of the bearing 63. This adjustment feature is provided by means of a threaded stud 66 at the left-most end of the bearing member 63, with the stud 66 being carried in a rotationally adjustable stud mounting wheel 67, in threaded engagement therewith. The stud mounting wheel 67 is fixed in position against leftward or rightward movement as viewed in FIGS. 2 and 4, by means of a pair of fixedly mounted locating pins 68 extending across the opening 64, into the opposite sides of the bar 20, as shown in FIG. 4. The upper end of the adjustment wheel 67 as viewed in FIG. 2 is provided with a spring-biased ball 70 carried in a bore 71 in the bar 20, with a spring member 72 therein, urging the ball 70 into engagement with an associated one of a series of detents 73 on the periphery of the adjustment wheel 67, depending upon the position of the wheel 67. Thus, the ball 70 provides for stability for the wheel 67, at its upper end. The adjustment may be effected by means of a workman moving the wheel 67 through an arc, thereby moving the bearing 63 leftward, or rightward, as viewed in FIGS. 2 and 4, to obtain the appropriate position for the pivot pin 62.

It will also be seen that the desired adjustments for the bar 20, by means of the rod 30, at its upper and lower end, and the adjustment for the means for pivoting the door, at its upper end, is likewise provided.

It will be apparent from the foregoing that the objects of invention have been satisfied and that many variations may be utilized in the construction and adaptation of the invention as set forth herein, all within the spirit and scope of the invention as defined in the appended claims.

What is claimed is:

1. In a glass door assembly comprising at least one glass door, a glass transom above the glass door extending from the door to a building structure thereabove, and at least one glass sidelight, laterally of the door and transom, extending from the door and transom to a lateral building structure, the improvement comprising a generally horizontally disposed transom bar beneath the transom in weight-supporting engagement therewith, and with a generally vertically disposed bar support rod at at least one end of the transom, between the transom and an adjacent portion of a sidelight, said rod being supportingly carried at its upper end by the building structure, and with the lower end of the rod being in supporting engagement with the transom bar.

2. In a glass door assembly comprising at least one glass door, a glass transom above the glass door extending from the door to a building structure thereabove, and at least one glass sidelight, laterally of the door and transom, extending from the door and transom to a lateral building structure, the improvement comprising a generally horizontally disposed transom bar beneath the transom in weight supporting engagement therewith, and with a generally vertically disposed bar support rod at at least one end of the transom, between the transom and an adjacent portion of a sidelight, said rod being supportingly carried at its upper end by the building structure, and with the lower end of the rod being in supporting engagement with the transom bar, wherein said transom and adjacent sidelight portions have ends facing toward each other defining space for the rod therebetween, with said rod being thinner than the thickness of the glass of said transom and said sidelight, and with a sealant disposed in said space forming a rod-burying joint between ends of said transom and side light, whereby said bar presents an unsupported appearance at its rod-supported end.

3. The assembly of claim 1, wherein said rod is provided at its upper end with means facilitating vertical adjustment of the rod relative to the building structure.

4. The assembly of claim 1, wherein the rod is provided at its upper end with means facilitating lateral adjustment of the rod between the transom and sidelight.

5. The assembly of claim 1. wherein said support bar includes means at its said end adjacent said side light for securing said bar end to said side light.

6. In a glass door assembly comprising at least one glass door, a glass transom above the glass door extending from the door to a building structure thereabove, and at least one glass sidelight, laterally of the door and transom, extending from the door and transom to a lateral building structure, the improvement comprising a generally horizontally disposed transom bar beneath the transom in weight-supporting engagement therewith, and with a generally vertically disposed bar support rod at at least one end of the transom, between the transom and an adjacent portion of a sidelight, said rod being supportingly carried at its upper end by the building structure, and with the lower end of the rod being in supporting engagement with the transom bar, wherein said support bar includes means at its said end adjacent said side light for securing said bar end to said side light, wherein said securing means includes a notch means in said bar, in receiving engagement with an edge portion of said side light.

7. In a glass door assembly comprising at least one glass door, a glass transom above the glass door extending from the door to a building structure thereabove, and at least one glass sidelight, laterally of the door and transom, extending from the door and transom to a lateral building structure, the improvement comprising a generally horizontally disposed transom bar beneath the transom in weight-supporting engagement therewith, and with a generally vertically disposed bar support rod at at least one end of the transom, between the transom and an adjacent portion of a sidelight, said rod being supportingly carried at its upper end by the building structure, and with the lower end of the rod being in supporting engagement with the transom bar, wherein said door is provided with pivot pin means protruding upwardly toward said transom, and wherein bearing means is provided carried by said transom bar, in receiving engagement with said pivot pin.

8. The assembly of claim 7, wherein said bearing means is disposed in said bar.

9. In a glass door assembly comprising at least one glass door, a glass transom above the glass door extending from the door to a building structure thereabove, and at least one glass sidelight, laterally of the door and transom, extending from the door and transom to a lateral building structure, the improvement comprising a generally horizontally disposed transom bar beneath the transom in weight-supporting engagement therewith, and with a generally vertically disposed bar support rod at at least one end of the transom, between the transom and an adjacent portion of a sidelight, said rod being supportingly carried at its upper end by the building structure, and with the lower end of the rod being in supporting engagement with the transom bar, including adjustment means being provided, carried by said bar, for adjusting the position of said bearing means along said bar, for adjusting the upper pivot for said door.

10. The assembly of claim 1, including means for adjusting the relative vertical positions of said bar and rod relative to each other.

11. In a glass door assembly comprising at least one glass door, a glass transom above the glass door extending from the door to a building structure thereabove, and at least one glass sidelight, laterally of the door and transom, extending from the door and transom to a lateral building structure, the improvement comprising a generally horizontally disposed transom bar, and with a generally vertically disposed bar support rod at at least one end of the transom, between the transom and an adjacent portion of a sidelight, said rod being supportingly carried at its upper end by the building structure, wherein said door is provided with pivot pin means protruding upwardly toward said transom, and wherein bearing means is provided carried by said transom bar, in receiving engagement with said pivot pin means.

12. The assembly of claim 11, wherein said bearing means is disposed in said bar.

13. The assembly of claim 11, wherein said transom and adjacent sidelight portions have ends facing toward each other defining space for the rod therebetween, with said rod being thinner than the thickness of the glass of said transom and said sidelight, and with a sealant disposed in said space forming a rod-burying joint between ends of said transom and sidelight, whereby said bar presents an unsupported appearance at its supported end.

14. In a glass door assembly comprising at least one glass door, a glass transom above the glass door extending from the door to a building structure thereabove, and at least one glass sidelight, laterally of the door and transom, extending from the door and transom to a lateral building structure, the improvement comprising a generally horizontally disposed transom bar beneath the transom in weight-supporting engagement therewith, and with a generally vertically disposed bar support rod at at least one end of the transom, between the transom and adjacent portion of a sidelight, said rod being supportingly carried at its upper end by the building structure, and with the lower end of the rod being in supporting engagement with the transom bar, wherein said transom and adjacent sidelight portions have ends facing toward each other defining space for the rod therebetween, with said rod being thinner than the thickness of the glass of said transom and said sidelight, and with a sealant disposed in said space forming a rod-burying joint between ends of said transom and sidelight, whereby said bar presents an unsupported appearance at its rod-supported end, wherein said rod is provided at its upper end with means faciliatating vertical adjustment of the rod relative to the building structure, wherein the rod is provided at its upper end with means facilitating lateral adjustment of the rod between the transom and side light, wherein said support bar includes means at its said end adjacent said sidelight for securing said bar end to said sidelight, wherein said securing means includes a notch means in said bar, in receiving engagement with an edge portion of said sidelight, wherein said door is provided with pivot pin means protruding upwardly toward said transom, and wherein bearing means is provided carried by said transom bar, in receiving engagement with said pivot pin, wherein said bearing means is disposed in said bar, including adjustment means being provided carried by said bar, for adjusting the position of said bearing means along said bar, for adjusting the upper pivot for said door, including means for adjusting the relative vertical positions of said bar and rod relative to each other.

15. The assembly of claim 2, wherein there are sidelights on each side of said transom, and wherein there are bar support rods at each end of the transom for supporting said bar at its each said end between the transom and sidelights, whereby the bar presents a floating appearance.

16. The assembly of claim 1, wherein said transom and said sidelight are free of openings therethrough, around the door.

17. In a glass door assembly comprising at least one glass door, a glass transom above the glass door extending from the door to a building structure thereabove, and at least one glass sidelight, laterally of the door and transom, extending from the door and transom to a lateral building structure, the improvement comprising a generally horizontally disposed transom bar beneath the transom, wherein said transom and said sidelight are free of openings therethrough, around the door.

* * * * *